United States Patent [19]

Kilgore

[11] Patent Number: 5,069,242

[45] Date of Patent: Dec. 3, 1991

[54] GAS LIFT VALVE UTILIZING A DIAPHRAGM PILOT

[75] Inventor: Marion D. Kilgore, Dallas, Tex.

[73] Assignee: Otis Engineering Corporation, Dallas, Tex.

[21] Appl. No.: 645,699

[22] Filed: Jan. 25, 1991

[51] Int. Cl.[5] ..... F04F 1/20

[52] U.S. Cl. ..... 137/155; 251/61.2

[58] Field of Search ..... 137/155, 510; 251/61, 251/61.2, 61.4; 92/96, 103 R, 103 SP, 97, 99

[56] References Cited

U.S. PATENT DOCUMENTS

| | | | |
|---|---|---|---|
| Re. 25,292 | 12/1962 | Dudley | 137/155 |
| 2,573,110 | 10/1951 | Robison | 137/155 |
| 2,994,335 | 8/1961 | Dudley | 137/155 |
| 3,086,593 | 4/1963 | Chitwood | 166/224 |
| 3,125,113 | 3/1964 | Lamb et al. | 137/155 |
| 3,183,922 | 5/1965 | Lamb et al. | 137/155 |
| 3,311,126 | 3/1967 | Dudley | 137/155 |
| 3,311,127 | 3/1967 | Dudley | 137/155 |
| 3,398,760 | 8/1968 | Fox | 137/155 |
| 4,078,580 | 3/1978 | Rudle | 92/103 SD X |
| 4,270,441 | 6/1981 | Tuck | 92/98 R X |

*Primary Examiner*—Alan Cohan

*Attorney, Agent, or Firm*—Albert W. Carroll

[57] ABSTRACT

A pilot operated gas lift valve utilizing a diaphragm formed of polymeric or elastomeric material and exposed to lift gas pressure on one side and atmospheric pressure on the other side, the diaphragm being able to withstand very high differential pressures and endure an extremely great number of operating cycles. The gas lift valve may be provided with an extension on the pilot valve member and this extension is exposed at all times to production fluid pressure, in which case, production fluid pressure will affect the operation of the gas lift valve. Thus, the gas lift valve may be 100 percent sensitive to production fluid pressure and totally insensitive to lift gas pressure, or its sensitivity to production fluid pressure may be as little as about four percent, depending upon the cross sectional area of the extension. Use of the diaphragm in the pilot valve mechanism provides essentially friction free operaton. Use of atmospheric pressure and a spring on the side of the diaphragm opposite the lift gas pressure avoids the effects of downhole temperatures on the pilot valve. Diaphragms formed of Teflon, especially virgin Teflon are disclosed should last for the life of most gas lift wells, and for operation in excess of 100,000 cycles. Also, diaphragms formed of elastomeric materials are also disclosed.

17 Claims, 5 Drawing Sheets

GAS LIFT VALVE UTILIZING A DIAPHRAGM PILOT

BACKGROUND OF THE INVENTION

1. Field of the Invention

This invention relates to wells which are produced by means of gas lift operations, and more particularly to a gas lift valve for use in such gas lift operations.

2. Related Art and Information

Gas lift valves have been used for many years to aid in the production of oil wells lacking sufficient natural pressure to flow naturally without assistance. Such valves commonly control the admission of lift gas into the well tubing from the well casing to aid in lifting formation liquids to the surface. Lift gas is generally injected into the well casing at the surface. Several types of gas lift valves have been known. Some gas lift valves open in response to casing pressure, some in response to tubing pressure, some admit gas into the tubing continuously, others intermittently. Some gas lift valves, for instance, are provided with main valves which are pilot actuated, that is, when their pilot valves open, their main valves are caused to open, and when their pilot valves close, their main valves close in response thereto. The pilot valve may respond to casing pressure or to tubing pressure or to the difference between those two pressures.

Listed here are certain U.S. patents which disclose prior gas lift valves which may be pertinent to the invention disclosed and claimed in this present application.

| | | | |
|---|---|---|---|
| Re. 25,292 | 2,994,335 | 3,086,593 | 3,125,113 |
| 3,183,922 | 3,311,126 | 3,311,127 | |

U.S. Pat. No. 2,994,335 issued to W. A. Dudley on Aug. 1, 1961 and its reissue Patent Re. 25,292 issued on Dec. 4, 1962, disclose a gas lift valve which has a pilot valve with a bellows and spring, the spring for biasing the pilot valve toward closed position and the bellows, exposed to casing pressure for moving the pilot valve toward open position. When casing pressure rises to a predetermined value the bellows lifts the pilot valve to open position in opposition to the spring. When the pilot valve opens casing pressure enters through the pilot valve to act upon the main valve and move it to open position against the force of its spring to allow transfer of lift gas into the tubing. When the casing pressure falls below a predetermined value the pilot valve will close and this will result in the main valve closing, it being moved by its spring.

U.S. Pat. No. 3,086,593 which issued on Apr. 29, 1963 to C.B. Chitwood discloses a gas lift valve having a pilot valve including a bellows attached to the pilot valve member and charged with a compressed gas. The bellows hold the pilot valve on its seat (closed) when the casing pressure to which it is exposed is below a predetermined level. When the casing pressure rises above such predetermined level, the bellows will be compressed and will unseat (open) the pilot valve. Opening the pilot valve allows casing pressure to move the main valve to open position against the compression of its spring. When casing pressure falls below the predetermined level, the pilot valve closes, whereupon the main valve is returned to closed position by the spring.

U.S. Pat. No. 3,125,113 issued to C.P. Lamb, et al., on Mar. 17, 1964. This patent discloses a gas lift valve which is controlled by a pilot employing a bellows 37 (FIG. 1A) and 76 (FIG. 3). When pressure exterior of the bellows compresses the same, the pilot valve 75 is lifted off its seat 74 and casing pressure passing through the open pilot valve and through passage 77 into chamber 67 to act upon piston 66 to open main valve 65.

U.S. Pat. No. 3,183,922 which issued May 18, 1965 to C.P. Lamb, et al., discloses a pilot operated gas lift valve. The pilot valve (ball 72) is held on seat 71 by pilot spring 74 and bellows 63. The bellows is exposed to tubing pressure conducted thereto through outlet 21, main valve stem bore 34, and passage 62. Casing pressure is communicated to the ball and seat via passage 59. When casing pressure increases to a predetermined value, ball 72 will be unseated and casing pressure flowing through the seat will pass through passage 62 and will be applied to piston 35 to thus move it down in opposition to main valve spring 44. Main valve 48 attached to the piston will thus be unseated and moved to its open position. When the casing pressure falls to a predetermined value, the pilot spring and the bellows will return the ball 72 to its seat to bar further entry of casing pressure. This will allow tubing pressure to equalize on upper and lower sides of the piston and permit spring 44 to close the main valve.

U.S. Pat. No. 3,311,126 which issued to William A. Dudley on Mar. 28, 1967 and discloses a pilot operated gas lift valve. This device has a pilot valve 60 which engages seat 70. Pilot spring 75 biases the pilot valve towards its seat. A bellows 72 is also connected to the pilot valve. Port 69 communicates casing pressure into the pilot valve chamber. When casing pressure reaches a selected level, the bellows 72 compresses, overcomes spring 75, and lifts pilot valve 68 off its seat. Casing pressure then flows through seat 70 and its passage 71 into the chamber (47) therebelow where it acts upon piston (18). The piston is thus depressed, compressing spring 55 and opening the main valve 17 to permit flow of lift gas from the casing into the tubing through inlet screen 38, inlet ports 37 and through bores 42 and 43, to exit through outlet ports 39. When the casing pressure falls below the selected level, pilot valve 68 closes, chamber (47) is shut off from the casing pressure and becomes equalized with tubing pressure, the excess pressure bleeding to the tubing through bore 64 of the piston (18) and its stem 17. With pressures equalized above and below the piston, main valve spring 55 moves the main valve to closed position.

U.S. Pat. No. 3,311,127 issued to William A. Dudley on Mar. 28, 1967 and discloses a pilot operated gas lift valve in which two pressure responsive members 35 and 53 are used as bellow-phragms to contain an incompressible liquid therebetween. This liquid is metered through adjustable needle valves to control the length of time that the gas lift valve remains open before it closes. This patent is not believed to be pertinent to the instant application.

No pilot operated gas lift valve was found in the prior art having a diaphragm subject to lift gas pressure and functioning to unseat the pilot valve to cause opening of gas lift valve.

SUMMARY OF THE INVENTION

The present invention is directed toward a pilot operated gas lift valve having body means with a flow course therethrough connecting an inlet opening with an outlet opening, and means for connecting the same in a well flow conductor, a main valve in the body for controlling flow therethrough, a spring for biasing the main valve toward closed position and a pilot valve for controlling opening and closing of the main valve, the pilot valve having a seat, a stem for closing the seat, a spring biasing the stem toward seat-closing position, and a diaphragm engaged with the stem and responsive to lift gas pressure for unseating the stem and allowing lift gas to then act upon a piston which will subsequently move the main valve to open position.

It is therefore one object of this invention to provide a pilot operated gas lift valve in which a diaphragm sensitive to lift gas pressure functions to move the pilot valve to open position.

Another object is to provide a gas lift valve having a pilot having no sliding seals and its pilot valve member therefore operates virtually without friction.

Another object is to provide such a pilot operated gas lift valve in which such diaphragm will withstand very high pressure.

Another object is to provide such gas lift valve in which the diaphragm is especially long lasting.

Another object of this invention is to provide such improved pilot operated gas lift valve which the affects of temperatures are negligible.

Another object is to provide a pilot operated gas lift valve of the character described whose main valve and body are provided with metal-to-metal seals which co-engage to close the flow course therethrough.

Another object is to provide such a gas lift valve in which when the main valve is closed a positive pressure acts thereon to help maintain it in closed position.

Another object of this invention is to provide a pilot operated gas lift valve of the character described which is adapted for use in the offset receptacle of a side pocket mandrel.

Another object of this invention is to provide a pilot operated gas lift valve adapted for mounting on the exterior of a well tubing.

Other objects and advantages may become apparent from reading the description which follows and from studying the accompanying drawings, wherein:

DESCRIPTION OF THE PREFERRED EMBODIMENTS

Figure 1:
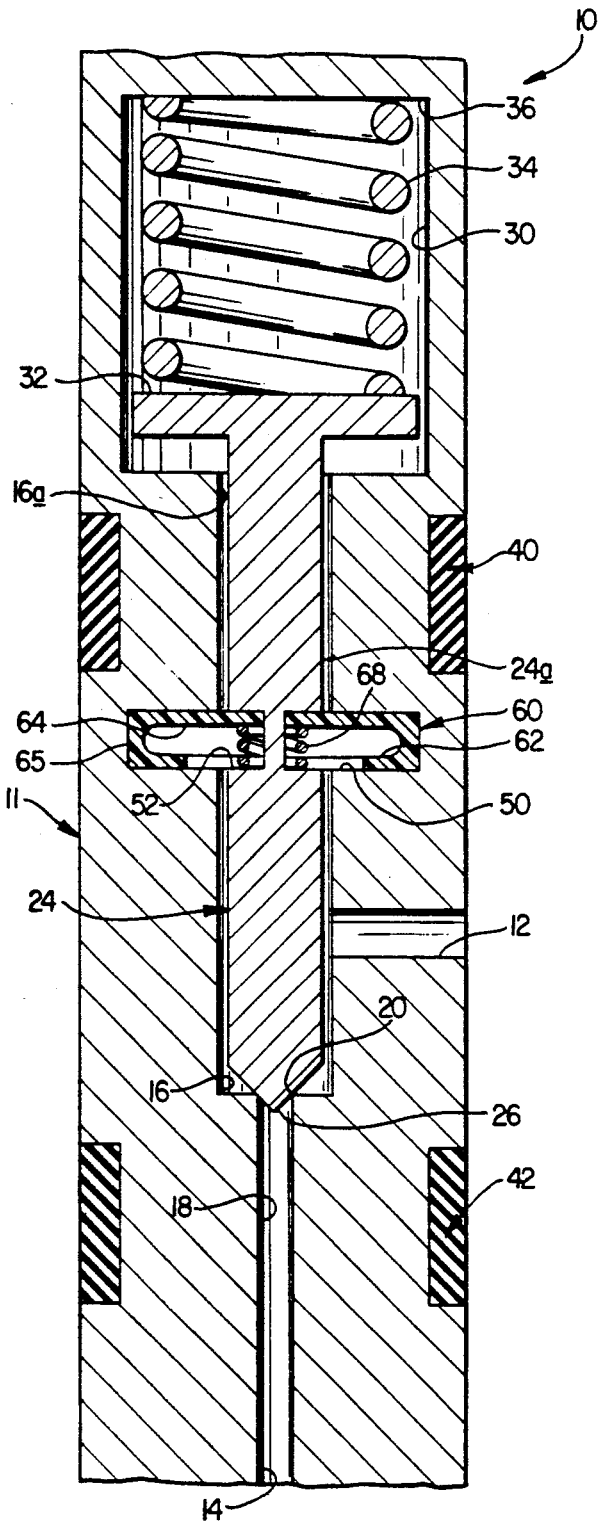
FIG. 1 is a fragmentary schematical view illustrating a pilot valve of the type utilized in this invention.

Referring now to FIG. 1, it will be seen that a pilot valve 10 for controlling an associated valve (not shown) is schematically illustrated. Valve 10 includes a housing 11 having a passage therethrough providing an inlet 12 and an outlet 14. Inlet 12 intersects a bore 16 which is reduced as at smaller bore 18. A valve seat is provided as at 20 where small bore 18 opens into bore 16. A valve member 24 having a tip 26 is shown engaged with and closing the seat 20 but is movable away from seat 20 to permit fluid communication therethrough between the inlet 12 and the outlet 14. In normal use, flow takes place through the pilot from the inlet 12 to the outlet 14 when the valve member 24 is not engaged with seat 20.

Valve member 24 extends upwardly through bore 16 and into chamber 30. The valve member terminates at its upper end with a large flat head 32. A pilot spring 34 having its upper end engaged with the upper end 36 of chamber 30 has its lower end resting upon the upper end of the flat head 32. The compression in main spring 34 biases the valve member 24 downwardly, forcing the valve tip 26 into intimate contact with seat 20 so that the pilot valve is normally closed.

The valve housing 11 is provided with a first annular seal 40 and a second annular seal 42 which normally seal above and below the inlet port 12 to direct upstream pressure thereinto.

Between the inlet 12 and the chamber 30, the valve housing 11 is provided with an internal annular recess 50 which surrounds bore 16, as shown. Also, the valve member 24 is provided with an external annular recess 52. Recesses 50 and 52, ideally, have their upper ends at the same level when valve tip 26 is seated on seat 20. As shown, recesses 50, 52 are of equal width, which results in their lower ends being aligned also, but such is not necessary.

A diaphragm 60 is disposed in recess 50 and is provided with a short lower lip 62 and with a long upper lip 64. Both of these lips extend radially inwardly, as shown from the web 65 of the diaphragm. It is noticed that the upper lip 64 extends deep into recess 52 of the valve member 24 but lower lip 62 stops short of reaching stem 24. Diaphragm 60 may be made of a sturdy but flexible polymeric material such as Nylon, Teflon, Delrin, Polyamide, or the like. This upper lip 64 bridges the gap between the inner wall 16*a* of bore 16 and the outer surface 24*a* of the valve member 24.

A spring indicated by the reference numeral 68 biases the upper lip 64 of the diaphragm 60 against the upper wall of recess 52 to establish an initial seal and prevent leaking of gas or liquids into chamber 30.

Pressure, which enters housing 11 inlet 12 is communicated by bore 16 to recess 50 where it acts upon diaphragm 60 to press it into intimate sealing contact with the walls of recess 50. This pressure also presses the upper lip 64 into intimate contact with the upper wall of recess 52 Thus, the upper lip of diaphragm 60 seals between the valve member 24 and the housing 11 and prevents pressurization of chamber 30, which remains at atmospheric pressure.

In conventional use of pilot valve 10 in a gas lift well, casing pressure would be communicated to the inlet 12 and the tubing pressure would be communicated to the outlet 14. Thus, when valve tip 26 is spaced from seat 20, lift gas from the casing would enter the pilot valve through inlet port 12 and would find its way to the closed valve seat 20 and also to the diaphragm 60. Thus, tubing pressure would act upon that area of the valve tip 26 which is exposed, as shown, below the surface of seat 20. Tubing pressure acting upon this area of the valve member sealed by the seat 16 constitutes a force which tends to lift and thus unseat the valve member.

Casing pressure acts against upper lip 64, tending to flex it upwardly and lift the valve member, thus tending to unseat the valve also.

Casing pressure acts upwardly against that portion of the lower end of the valve which is above the seat 20. This, too, constitutes a force tending to lift the valve member and unseat the valve.

Casing pressure acts equally in both upward and downward directions in external recess 52 of the valve member and the resulting upward and downward forces obviously balance or cancel one another.

The casing pressure can, if it is sufficiently great, lift the valve member off seat against the downward force of pilot spring 34. This, of course, causes the upper lip 64 of the seal member to flex. The point of flexure may be taken as located along a circular path which lies approximately midway between the outer cylindrical surface of the valve member and the inner cylindrical surface of the housing at the upper lip of the diaphragm. This circle defines the pressure sensitive area of the pilot valve 10.

At the time that the valve member is unseated, the force of the tubing pressure acting upwardly against the exposed area of the valve tip plus the force of the casing pressure acting upwardly against the pressure sensitive area minus the exposed area of the valve tip must equal the force of pilot spring 34. Thus:

$$F_{ps}=P_t(A_{vt})+P_c(A_s-A_{vt})$$

where:

$F_{ps}$=Force of pilot spring
$P_t$=Pressure in tubing
$A_{vt}$=Area of valve tip
$P_c$=Pressure in casing
$A_s$=Sensitive area of pilot valve The pilot spring 34 may be adjusted by suitable means (not shown) so that it will open when the conditions of pressure at inlet 12 and outlet 14 reach levels predetermined.

Figure 2A:
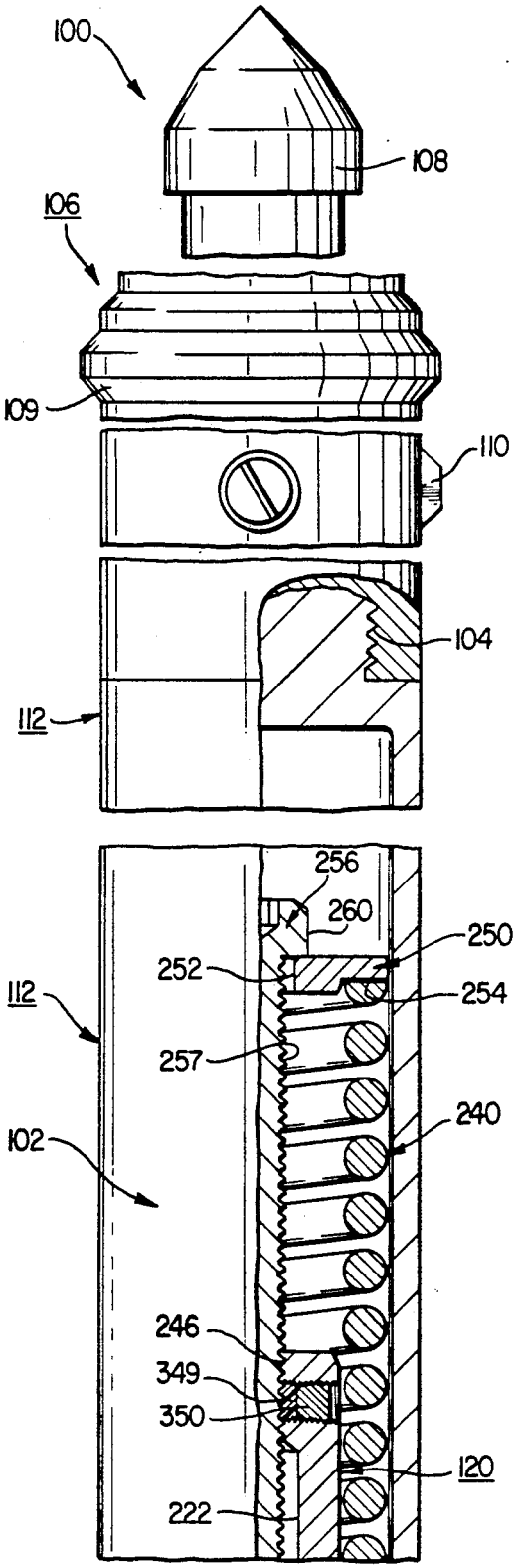
FIGS. 2A, 2B, and 2C, taken together constitute a longitudinal view, partly in elevation and partly in section, showing upper, intermediate, and lower portions of a gas lift valve of this invention.
Figure 2B:
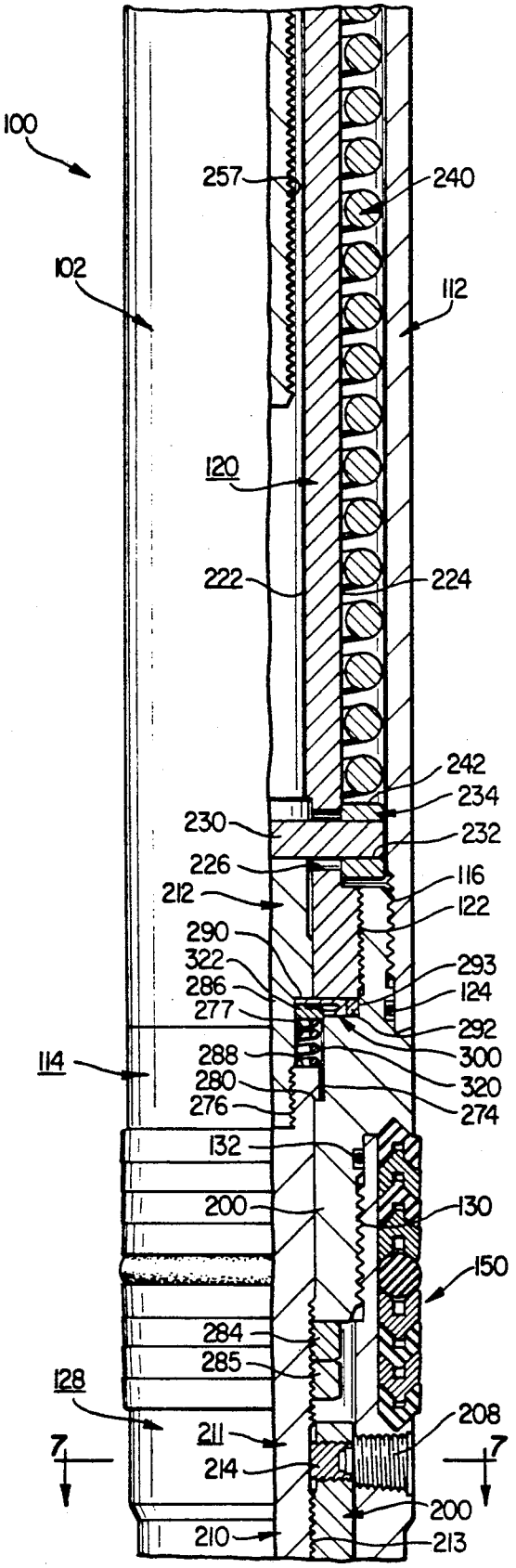
Figure 2C:
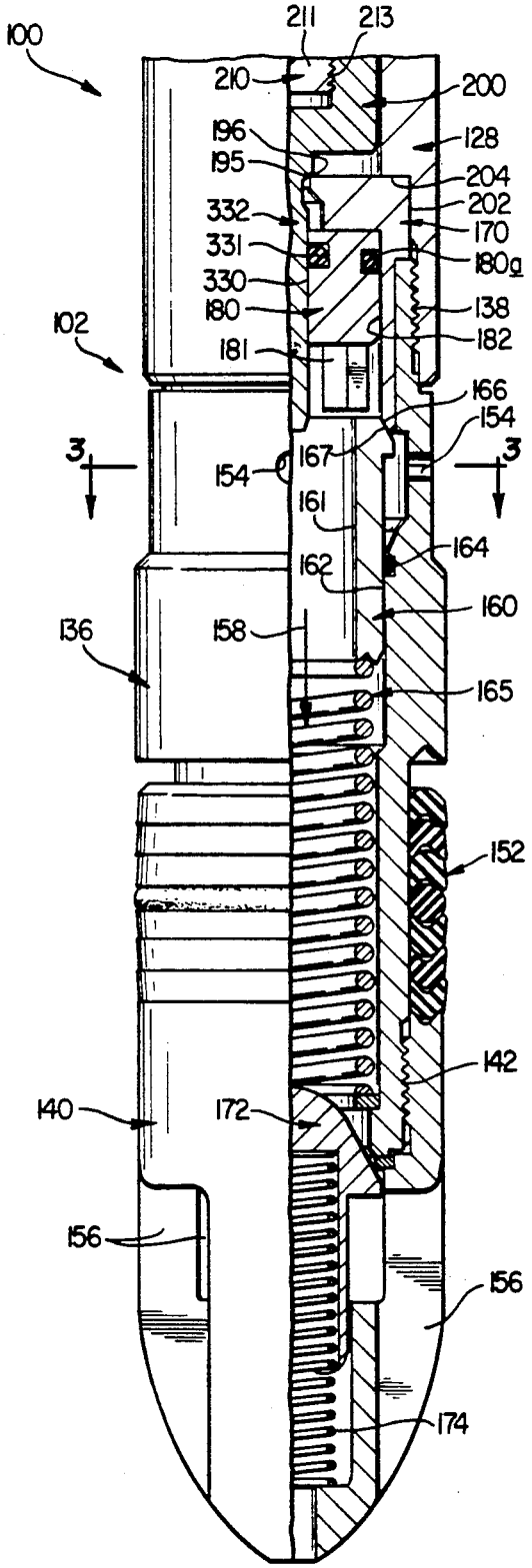

A pilot operated gas lift valve constructed in accordance with the present invention is illustrated in FIGS. 2A, 2B, and 2C where it is indicated generally by the reference numeral 100. Gas lift valve 100 utilizes a pilot valve which operates upon the same principles as does the pilot valve schematically shown in FIG. 1 as just described.

Device 100, as shown, is adapted for installation in a side pocket mandrel (not shown). Side pocket mandrels are well known. They typically are formed with a belly or side pocket in which an offset receptacle is located. The offset receptacle is substantially parallel to the bore of the well tubing of which it forms a part. The receptacle will receive a gas lift valve installed therein through use of a kickover tool and wireline apparatus by which such gas lift valve may also be retrieved. The offset receptacle has a lateral port in its wall, and when the gas lift valve is installed in the side pocket mandrel, it is locked and sealed therein with its inlet port in communication with the lateral port of the receptacle. Such is the case for gas lift wells which produce well fluids through the tubing in response to lift gas being injected into the casing at the surface. If gas is to be injected into the tubing and well products are to be produced through the casing, side pocket mandrels for such installations are available. Side pocket mandrels and gas lift valves of various types are available from Otis Engineering Corporation, Post Office Box 819052, Dallas, TX 75381-9052.

Gas lift valve 100 includes body means 102 which is shown attached as by thread 104 to a latch 106 having a fishing neck 108 by which a handling tool such as a kickover tool releasably engages the device for installing the same in or removing it from a well. The latch 106 includes a downwardly facing stop shoulder 109 for limiting downward movement of the latch in the receptacle of the side pocket mandrel, and a latch lug 110 which engages below a lock shoulder in the receptacle for releasably locking the device in the receptacle. The device is releasable by upward jarring impacts which cause shearing of a pin (not shown) to permit the lug 110 to retract. The device can then be withdrawn from the receptacle and the well.

Body means 102 comprises a spring housing 112 whose upper end is connected directly to the lower end of the latch 106 as at thread 104, an intermediate pilot housing 114 attached as by thread 116 to the lower end of spring housing 112, an upper pilot housing 120 which is attached as by thread 122 to the upper end of intermediate pilot housing 114 and extends upwardly inside the spring housing 112. The connection at thread 116 is sealed by suitable seal means, such as resilient o-ring seal 124, to help maintain atmospheric pressure inside the spring housing.

Lower pilot housing 128 is connected to the lower end of intermediate pilot housing as by thread 130 and this connection is sealed by o-ring 132. Main valve housing 136 is connected to the lower end of lower pilot housing 128 as by thread 138, and this thread need not be sealed. A nose 140 is connected to the lower end of main valve housing 136 as by thread 142 as shown.

The device 100 carries the usual packing means including an upper packing set 150, at the connection of the intermediate pilot housing to the lower pilot housing for sealingly engaging the inner wall of the side pocket receptacle above its lateral port, and a lower packing set 152 for sealingly similarly engaging the side pocket receptacle below its lateral port.

The main valve housing 136 is provided with inlet means comprising one or more inlet ports such as inlet 154. The inlet means have a flow capacity sufficiently small to choke the flow of lift gas as desired so that when the main valve is open, casing pressure will exist exterior thereof and tubing pressure will exist interior thereof. It is preferable to provide plural inlets in order to balance the entry of lift gas therethrough. Four such inlet ports are recommended, and four one-eighth inch (3.175 millimeters) ports, for instance, might perform well in some installations. The flow capacity of the inlet means is in any case determined by the quantity of lift gas required for the desired production rate in the installation, considerations being given to the well productivity, depth of the gas lift valve, tubing size, pressure and density of the lift gas, et cetera. The nose 140 on the lower end of main valve housing is formed with suitable outlet means such as windows 156. A flow passage indicated by the arrow 158 connects inlet 154 with outlet 156. Windows 156 communicate With the outlet of the receptacle. Thus, when the gas lift valve is open, as will be explained, lift gas may transfer from the casing to the tubing through the receptacle and the device 100 disposed therein. When the valve is closed, such transfer of lift gas is prohibited.

Figure 3:
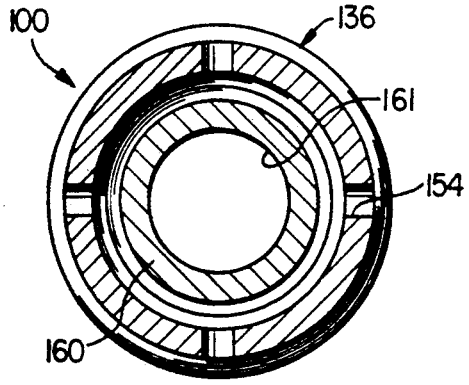
FIG. 3 is a cross-sectional view taken along line 3—3 of FIG. 2C.

Main valve member 160 having a bore 161 is slidably mounted in bore 162 of main valve housing 136 and is at all times sealingly engaged by annular seal ring 164 and is biased by main spring 165 toward its closed position, seen in FIG. 2C, wherein its tapered seal surface 166 sealingly engages corresponding main seat surface 167 of seat member 170. Thus, when main valve 160 is seated as shown in FIG. 2C, lift gas entering main valve housing 136 through inlet 154 cannot move past the engaged seats 166, 167, or past the seal 164 (See FIG. 3). When, however, the main valve member 160 is moved away from its seat, lift gas may flow from inlet 154, pass between the seat surfaces 166, 167, then move downwardly through passage 158 (arrow), depress check valve 172 against the compression of spring 174 and exit the device through windows 156 of nose 140 and into the well tubing.

The area sealed by engagement of seat surface 166 at the upper end of main valve 160 is slightly larger than the area sealed by annular seal 164, thus providing added force to aid spring 165 in holding main valve 160 firmly engaged in its closed position. It is readily seen, then, that when the main valve is unseated and flow takes place through inlet ports 154, these ports restrict such flow and casing pressure no longer biases the main valve upwardly. Casing pressure above piston 180 then moves the main valve to its full open position without delay.

When the main valve 160 is allowed to be returned to its seat by the compression of main spring 165, as when the force holding the main valve open subsides, flow through the gas lift valve will be stopped and the check valve 172 will be closed by its spring 174.

Figure 4:
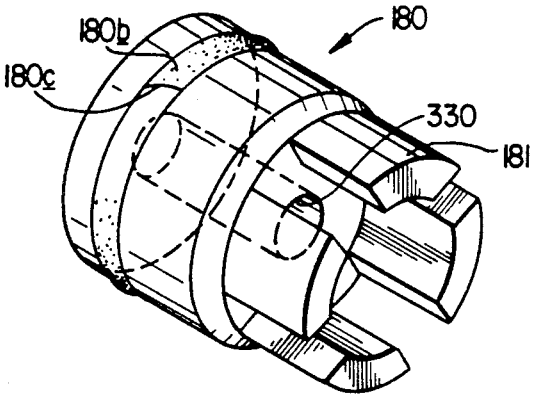
FIG. 4 is a schematical perspective view showing the piston of the gas lift valve of FIGS. 2A, 2B, and 2C.
Figure 5:
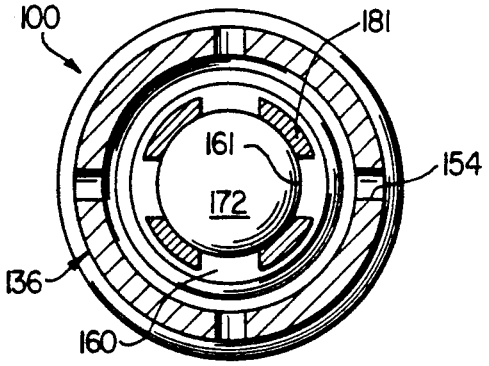
FIG. 5 is a cross-sectional view similar to that of FIG. 3 but showing the main valve open.

Main valve 160 is moved to open position by piston 180 (see FIG. 4) slidably mounted in cylinder bore 182 of seal member 170. Piston 180 has at least one finger 181 extending downwardly therefrom. This finger (or fingers) provides ample passage for allowing lift gas to enter the upper end of bore 161 of main valve 160, as seen in FIG. 5 where four fingers 181 are shown.

Opening and closing of main valve 160 is controlled by pilot valve means which is to be described.

Seat member 170 not only is provided with the cylinder bore 182 in which piston 180 is slidable and seat surface 167 engageable by main valve 160, but also is provided with a reduced bore at its upper end which provides a pilot seat surface 195 engageable by mating seat surface 196 formed on pilot valve 200, as shown.

Seat member 170 is formed with an external annular flange 202 which is confined between downwardly facing shoulder 204 of lower pilot housing 128 and the upper end face of main valve housing 136. Tightening of thread 138 secures the seat member 70 rigidly in place.

Figure 6:
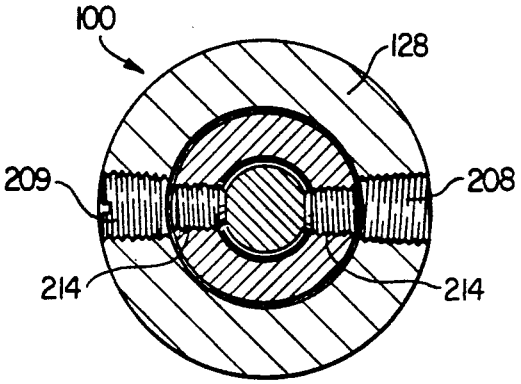
FIG. 6 is a schematical, oblique view showing the pilot valve diaphragm in section.

Lower pilot housing 128 is provided with a second inlet means comprising at least one lateral opening such as inlet 208 located above the first mentioned inlet means 154 and below upper packing set 150, thus communicating casing pressure into the lower pilot housing and also to the pilot seat 195. It may be desirable to provide two such inlet ports 208 as seen in FIG. 6.

Pilot valve 200, when seated upon seat surface 195 as shown in FIG. 2C prevents flow of lift gas therepast, but when the pilot valve is lifted from its seat, lift gas communicated thereto through second inlet 208 is allowed to flow therethrough and to bear upon the upper end of piston 180 causing it to be displaced downward. Such displacement of the piston causes its dependent fingers 181 to engage main valve 160 and move it downward against the compression of main spring 165, thus opening the main valve to permit the flow of lift gas through inlet 154, passage 158, past check valve 172 and out through windows 156 of nose 140 on its way to the well tubing. The lift gas thus transferred into the tubing helps to lift the well products to the surface.

Pilot valve 200 includes stem means 210 comprising lower pilot stem 211 and upper pilot stem 212 attached thereto as by thread 213 which is not at first tightened but is secured after adjustment as by screw 214. Screw 214 is installed but not tightened until proper adjustment has been made as will be described later, then screw 214 is tightened by access through lateral opening 208. Two such screws 214 may be desirable. If so, two ports 208 will be needed. Pilot valve stem 210 extends upwardly through bore 220 of intermediate pilot housing 114 and into bore 222 of upper pilot housing 120. Just above the level of the upper end of intermediate pilot housing 114, the upper pilot housing is reduced in diameter as at 224 and a pair of opposed openings such as holes or slots 226, are formed through its wall. A cross pin 230 extends through the pair of slots 226 and its opposite ends are received in holes 232 formed in a ring 234 which surrounds the upper pilot housing and has a free sliding fit thereon. Cross pin 230 rests across the upper end of upper valve stem 210.

A pilot spring such as coil spring 240 surrounds the upper pilot housing 120 and its lower end rests upon the upper face 242 of ring 234. The bore 222 of upper pilot housing 120 is reduced at its upper end and is internally threaded as 246. A suitable washer such as washer 250 having a central hole 252 therethrough and a downwardly facing shoulder 254 on its lower side is placed on the upper end of pilot spring 240. A bolt 256 having a thread 257 extends through the hole 252 of washer 250 and is threaded into thread 246 of upper pilot housing 120, as shown. The head 260 of the bolt 256 engages the upper side of the washer 250 and is tightened to compress spring 240 as desired. The spring load is transferred through ring 234 and cross pin 230 to the upper end of the pilot stem 210. The force of spring 240 thus biases the pilot valve toward seat 195 of seat member 170 as before explained.

The lower pilot stem 211 is formed with an external flange 274 at its upper end and with a central threaded upwardly opening blind bore as at 276, while the lower end is threaded as at 213 as mentioned before. Thread 276 is well tightened. The lower pilot stem 211 is disposed in bore 220 of intermediate housing 114 and its external flange 274 is engageable with a corresponding upwardly facing shoulder 280 to limit downward movement of the lower pilot stem during assembly and adjustment only. The flange 274 is never shouldered after adjustment has been completed. After adjustment, downward movement of the pilot stem is limited by engagement of the pilot valve seating surface 196 with the pilot seat surface 195.

Adjusting nut 284 is screwed onto thread 212 of lower pilot stem 211 and adjusted to limit upward movement thereof relative to the intermediate pilot housing 114, as needed. With flange 274 against shoulder 280 nut 284 is adjusted so that it is spaced say 0.020 inch (0.5 millimeter) from the lower end of intermediate pilot housing 114. This adjustment is preserved by tightening jam nut 285 against adjusting nut 284. After jam nut 285 has been tightened, the pilot stem is again moved down until its flange 274 is shouldered up, after which the clearance between nut 284 and the lower end of intermediate pilot housing 114 is checked. After jam nut 285 has been finally tightened, the stroke of the pilot valve 200 is adjusted.

The stroke of the pilot valve is adjusted while it is assembled, thusly: a wrench is inserted through each of the threaded openings 208 of lower pilot housing 128 and is engaged in each of the set screws 214. These wrenches will prevent the pilot valve member 200 from rotating while thread 213 is carefully unscrewed until the seat surface 196 of the pilot valve member 200 just touches the corresponding seat surface 195 of the seat member 170 and adjusting nut 284 just engages the intermediate pilot housing 114. Thread 213 is then further made up ¼ to ⅓ of a turn only, after which this adjustment is preserved by tightening the set screws 214, thread 213 being a 20-pitch thread. Thus, the stroke of the pilot valve stem is adjusted to 0.0125 to 0.0167 inch (about 0.3175 to 0.4233 millimeter).

Threaded openings 208 are left open for installation of the device 100 in a well since these openings provide passages for communicating casing pressure into the pilot mechanism.

The upper pilot stem 212 has its lower end portion reduced in diameter as at 286 and is threadedly connected into the threaded bore 276 at the upper end of the lower pilot stem 211. An external annular recess about the pilot stem is defined about the reduced diameter portion 286 and between the upper end face 288 of the lower pilot stem 211 and the downwardly facing shoulder 290 on the upper pilot stem 212.

A spacer ring 292 is interposed between the lower end face of upper pilot housing 120 and an upwardly facing shoulder formed in the intermediate pilot housing 114 by the enlarged bore which is threaded as at 122. This spacer controls the width of recess 293 and assures proper space for diaphragm 300, seen in FIG. 7.

Figure 7:
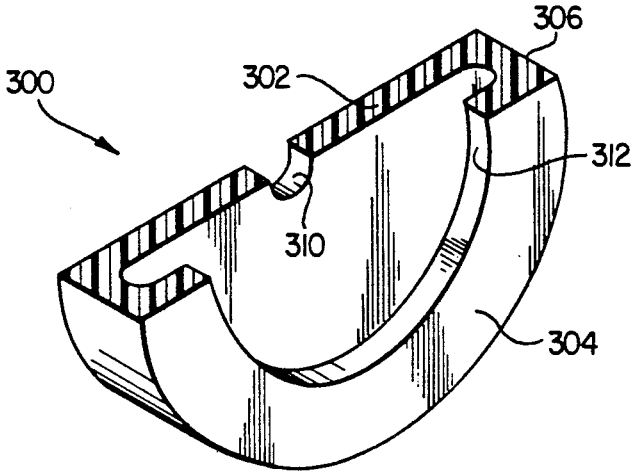
FIG. 7 is a cross-sectional view taken along line 7—7 of FIG. 2B.

Diaphragm 300 is shown schematically in FIG. 7. It is preferably formed as shown of a body of virgin Teflon (Tetraethylfluorocarbon) material. While other polymeric or elastomeric material might be usable for this application, Teflon was chosen because of its impermeability to well fluids. It is essentially formed with a first disklike wall 302 and a second similar wall 304 connected together at their outer edges by a web 306. The first wall is formed with a small central hole 310 therethrough and the second wall is formed with a large hole 312 therethrough. The first wall is the flexible portion and acts as a diaphragm. The small hole receives the lower reduced end of upper pilot stem 212 and is a fairly close, but not necessarily tight, fit therewith. The outer edge of the diaphragm is received in recess 293 and within the spacer 292 as shown in FIG. 2B. The inner portion of first wall 302 of the diaphragm engages and seals with downwardly facing shoulder 290 of upper pilot stem 212 and the outer portion thereof seals against the lower end of upper pilot housing 120. The second wall 304 engages and seals with the lower wall of internal recess 293.

Diaphragm 300 is formed with fairly thick walls and functions to seal the area thereabove inside and around the upper pilot housing and, of course within the spring housing 112, so that well fluids and the like cannot flow therepast and increase the pressure therein beyond atmospheric pressure.

To enhance the sealing of the diaphragm 300 with the downwardly facing shoulder 290 of upper pilot stem 212, a coil spring 320 is engaged between the upper end 288 of lower pilot stem 211 and the lower side of washer-like ring 322 having its upper side in contact with the lower side of the diaphragm as shown. The spring 320 thus applies an upward bias to the diaphragm at all times to assure its sealing contact with the upper pilot stem so that atmospheric pressure will be preserved in the region above the diaphragm. The inward portion of the upper face of ring 322 is raised as shown in order to concentrate the spring load at the lip of the diaphragm and further assure that the diaphragm will seal more dependably, even during low pressure conditions, both while the diaphragm is flexing and while it is flexed. Since the diaphragm must exclude fluids from the atmospheric chamber thereabove, it is highly recommended also that spring means be provided for pressing the short or lower lip of the diaphragm into firm sealing contact with upwardly facing shoulder 293 of the intermediate pilot housing 114. (Suitable springs for such applications are used on flange face seals for holding internal pressures. These are one-way seals. Such seals are available from FURON, Mechanical Seal Division, P.O. Box 520, Los Alamitos, CA 90720.)

Casing pressure entering the device through threaded inlet 208 acts upon the under side of diaphragm 300 tending to flex it upwardly and lift the pilot stem to unseat it from the pilot seat. The diaphragm thus provides a sensitive area which is sensitive to casing pressure. Atmospheric pressure in spring housing 112 acts upon the upper side of the diaphragm. The sensitive area of the diaphragm may be defined as the area within that circle which lies between the outside diameter of the upper pilot stem, at the shoulder 290, and the inside diameter of the upper pilot housing, at the lower end thereof. It is readily seen that, since the upper pilot stem is a fairly close sliding fit in the lower portion of bore 222, the sensitive area of the diaphragm is approximately equal to the cross-sectional area of the upper pilot stem where it contacts the upper side of the diaphragm.

It is readily seen that since the diaphragm seals about the pilot valve stem which only moves a very short distance, flexing the diaphragm, this movement is virtually friction free because no sliding seal means is used.

The pilot valve arrangement of the gas lift valve 100 differs from the pilot valve 10, illustrated in FIG. 1, in one important particular. While the pilot valve seating surfaces could be formed much like those of the pilot valve 10, and piston 180 could be formed solid, the piston 180, as seen in FIG. 2C is formed with a central bore 330 with an internal recess therein carrying a seal ring 331, and a probe 332 extends downward from the pilot valve sealing surface 196. This probe 332 may be formed integral with the pilot valve 200 or it may be formed separately therefrom and attached thereto by suitable means, such as a thread, for instance.

The probe 332 is not necessary and the pilot valve member 200 can be formed without it, if the pilot valve mechanism is to be insensitive to tubing pressure and respond to casing pressure alone.

The piston 180 (FIG. 4) is formed with an external annular recess near its upper end in which is carried a suitable non-sealing ring 180*a*. A Teflon ring 180*b* scarf-cut as at 180*c* has been found suitable. Also, two thinner scarf-cut Teflon rings (not shown) in the same recess have been substituted for ring 180*a* and found suitable. The piston must leak a little so that it can vacate the volume of gas above it when the pilot valve closes, since this is necessary if the main valve 160 is to be returned to its closed position by the main valve spring 165.

In order for the gas lift valve 100 to function properly the pilot valve must be adjusted to the required opening pressure based upon well conditions.

To adjust the pilot valve, a source of pressure is connected into the upper inlet 208. If two inlets 208 are provided, one must be plugged as by installing a pipe plug 209 therein, as shown in FIG. 6. The spring housing 112 is removed. The adjusting bolt 256 is screwed in, if necessary, to provide more than enough compression in pilot spring 240.

It should be understood that during assembly of the gas lift valve, a Nylon pellet 349 is placed in the threaded opening of the upper pilot housing, after which the set screw 350 is installed and tightened. The Nylon pellet 349 is thus compressed into firm engagement with thread 257 to maintain further adjustments of the bolt 256. This procedure is necessary since compression of the spring 240 results in its coils being too close together to permit access to screw 350 with a wrench.

Pressure is then applied to the pilot through the upper inlet 208. There should be no leaks. The pressure connected into the pilot is adjusted to equal the desired opening pressure for the pilot valve. Maintaining this desired opening pressure on the pilot, the adjusting bolt 256 is unscrewed slowly to reduce the compression in the pilot spring 240. When the compression in pilot spring becomes reduced sufficiently, the pressure in the pilot will flex the diaphragm and lift the pilot stem to unseat the pilot valve. This adjustment is preserved by tightening screw 350 to lock the adjusting bolt to the upper pilot housing.

Since the pilot valve 200 of gas lift valve 100 is provided with the dependent probe 332 whose cross-sectional area is exposed at all times to tubing pressure, the force of such tubing pressure acting upon the pilot mechanism must be taken into account. Of course, since the probe is smaller in area than the opening through the pilot valve seat surface 195, the probe has no affect upon the opening of the pilot valve. It does have its affect upon holding the main valve open.

The force-balance equation for opening of the pilot valve, therefore will be the same as that given hereinabove with respect to the pilot valve 10 of FIG. 1.

While the device 100 of FIGS. 2A, 2B, and 2C has been shown to utilize a diaphragm having upper and lower sealing lips, other forms of diaphragms may be used. And, while the diaphragm utilized in the device 100 was described as being formed of Teflon, preferably virgin Teflon, other materials (polymeric or elastomeric) might be used, especially in the diaphragms shown in FIGS. 8–12.

Figure 8:
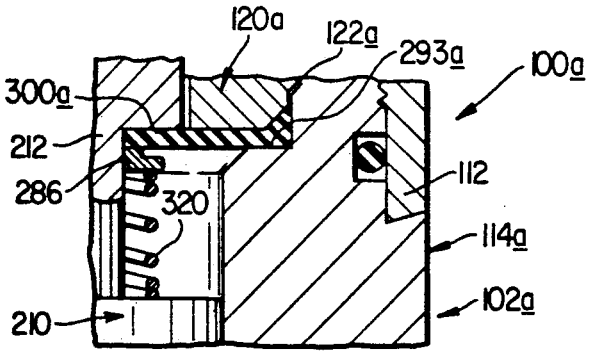
FIG. 8 is a fragmentary schematical sectional view showing a modified form of gas lift valve similar to the device of FIGS. 2A, 2B, and 2C, but showing a flat diaphragm having a ridge on the upper side of its outer portion.

Referring now to FIG. 8, it is seen that a modified form of gas lift valve 100*a* is shown which may be like that of device 100 with the exception of the diaphragm and the manner in which it sealingly engages with the housing.

Figure 9:
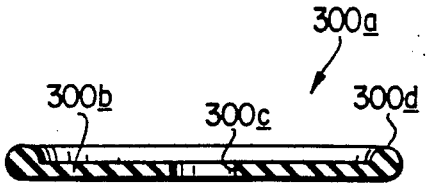
FIG. 9 is a cross-sectional view of the diaphragm used in the device of FIG. 8.
Figure 10:
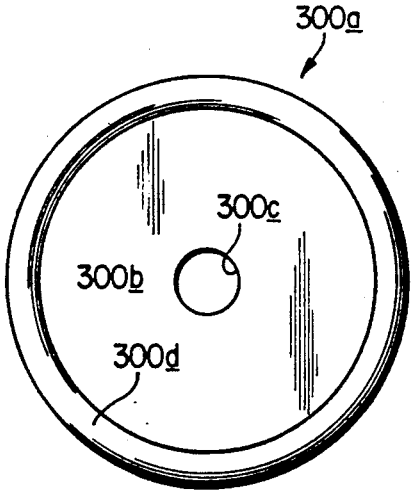
FIG. 10 is a top view of the diaphragm of FIG. 9.

The device 100*a* is provided with a diaphragm which is indicated by the reference numeral 300*a* and is illustrated in FIGS. 9 and 10.

In FIG. 9, it is seen that the diaphragm 300*a* is essentially in the form of a disk 300*b* having a central opening 300*c* for receiving the reduced diameter portion of the upper pilot valve stem 212 and having its outer edge thickened as by a ridge 300*d* as shown. The ridge extends above the upper surface of the diaphragm, but does not extend below the lower surface thereof.

In FIG. 8, it is seen that the outer edge portion of diaphragm 300*a* thickened by ridge 300*d* is engaged between upwardly facing shoulder 293*a* of intermediate pilot housing 114*a* and the lower chamfered end of upper pilot housing 102*a*. Upon tightening of the thread 122*a*, the ridge 300*d* of the diaphragm 300*a* is squeezed and deformed so as to be captured in the space provided at least in part by the chamfer and is effective to form a suitable seal between the diaphragm and the pilot housing 102*a*.

The diaphragm 300*a* is caused to sealingly engage the upper pilot valve stem 212 in exactly the same manner as before explained with respect to device 100 previously described. The inner portion of diaphragm 300*a* is pressed upwardly against the downwardly facing shoulder of the upper stem by the spring 320 acting through washer 286. Thus, the diaphragm 300*a* seals between the pilot valve stem and the pilot valve housing to prevent leakage of fluids into the atmospheric chamber within spring cover 112 while allowing the pilot valve stem 210 to move between its open and closed positions.

Figure 11:
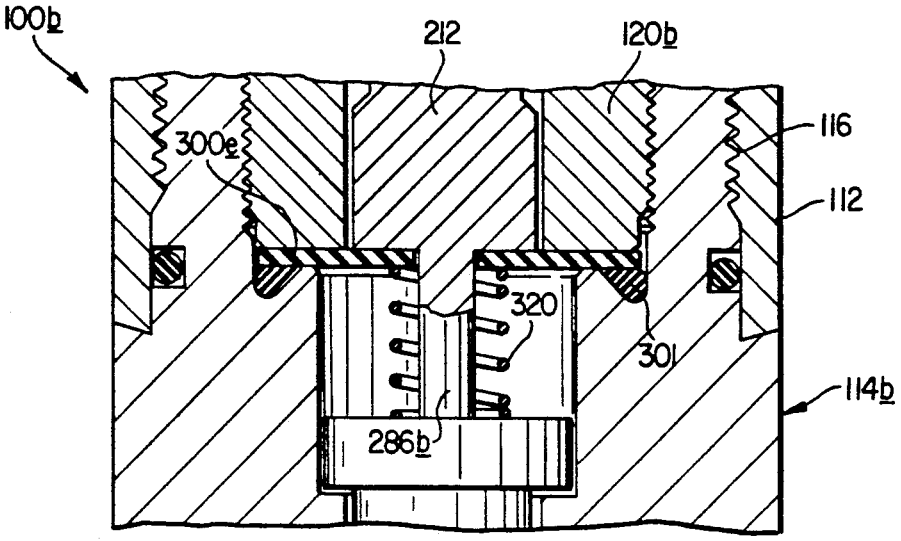
FIG. 11 is a view similar to that of FIG. 8, but showing another modified form of gas lift valve similar to the device of FIGS. 2A, 2B, and 2C but showing a diaphragm in the form of a flat disk having a central opening and having its outer portion sealingly engaged by a resilient seal ring carried by the housing.

In FIG. 11, the diaphragm 300*e* of device 100*b* is in the form of a plain flat disk having a central opening therethrough for receiving the reduced diameter portion 286*b* of upper pilot valve stem 212. The spring 320 causes the diaphragm to seal against the downwardly facing shoulder of the upper pilot valve stem while the outer portion of the diaphragm is sealed by a resilient seal ring such as o-ring 301 carried in a suitable recess formed in the intermediate pilot valve housing 114*b* as shown. While washer 286 is not shown in FIG. 11, its use is desirable. Tightening of the thread 122*b* causes the upper pilot valve housing 120*b* to press downwardly upon the diaphragm 300*e*, squeezing the seal ring 301 which seals both with the diaphragm and with the intermediate pilot valve housing 114*b*.

Figure 12:
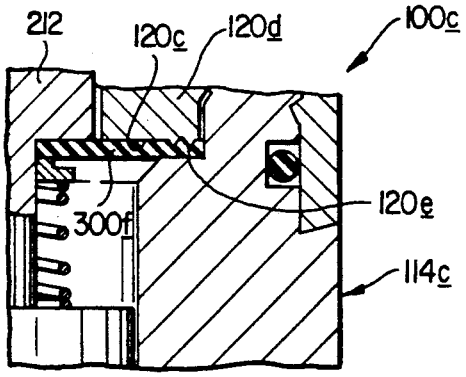
FIG. 12 is a view similar to that of FIG. 8, but showing another modified form of gas lift valve utilizing a diaphragm like that seen in the device of FIG. 11, but having its outer edge portion sealingly engaged with the housing by being gripped between mating parts of the housing.

Referring to FIG. 12, it is seen that the device 100*c* is provided with a diaphragm 300*f* which may be exactly like the diaphragm 300*e* shown in device 100*b* of FIG. 11, however, no o-ring or other resilient seal is used. Instead, the lower end face 120*c* of upper pilot housing 120*d* is formed with means such as one or more concentric ridges indicated at 120*e* projecting downwardly therefrom for increasing the stresses in the diaphragm material in order to enhance the effectiveness and dependability of the seal formed between the diaphragm and the intermediate pilot valve body 114*c*. The seal between the diaphragm and the pilot valve stem is effected in the same manner as before explained.

The material for diaphragms 300*a*, 300*b* and/or 300*c* may be selected from the polymeric materials, Teflon being the most impervious, or from the elastomeric materials. The elastomeric materials are generally more flexible than Teflon and other similar polymeric materials and may be more desirable under certain conditions. But, for use in gas lift wells, Teflon is generally to be preferred.

Figure 13:
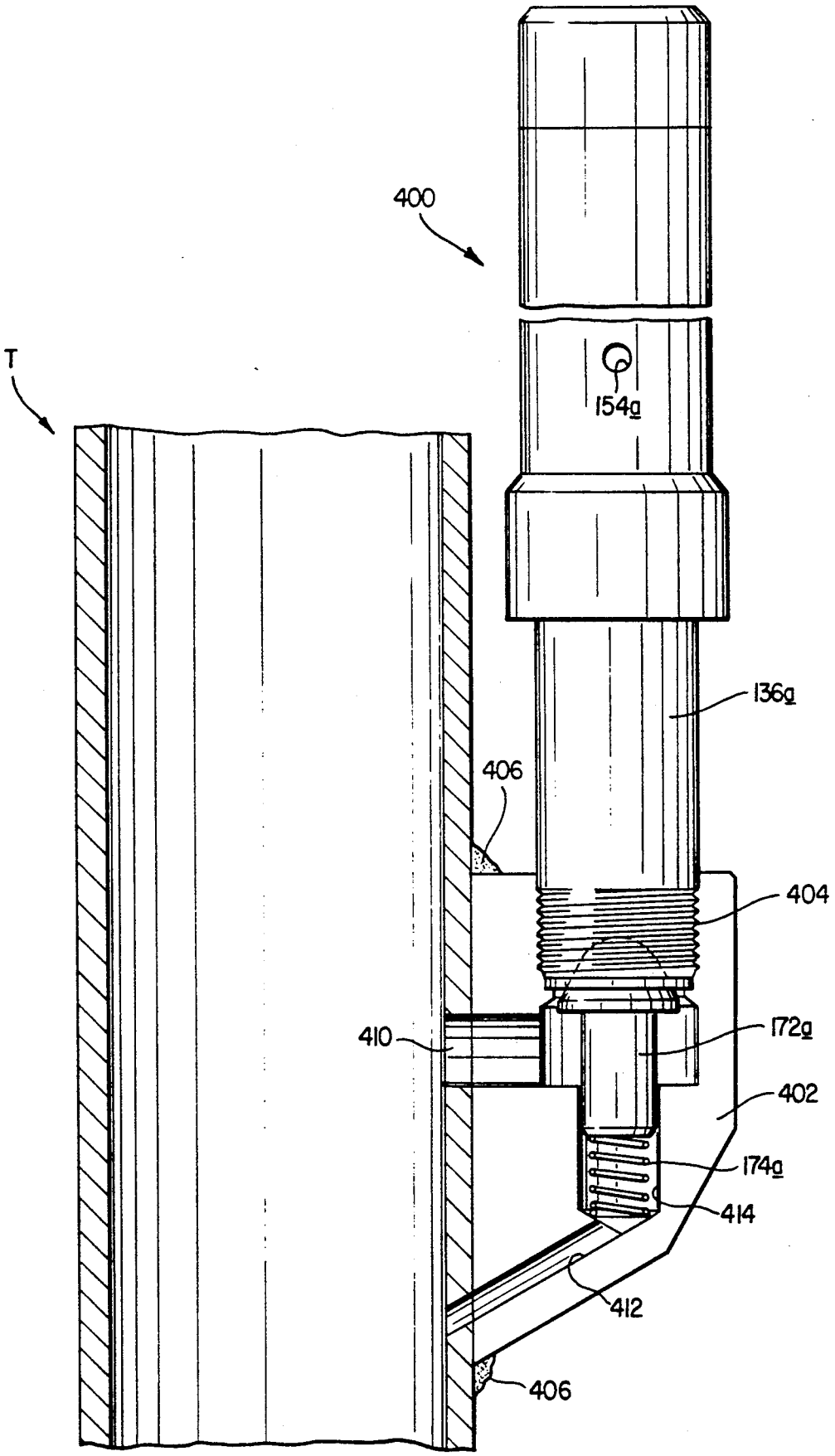
FIG. 13 is a fragmentary schematical view showing the device of this invention mounted on the exterior of a well tubing.

In FIG. 13, another form of the invention is illustrated. The pilot operated gas lift valve indicated by the reference numeral 400 is constructed exactly like the pilot operated gas lift valves previously described, but is adapted for attachment to the exterior of the well tubing T in a well known manner. Thus, the lower threaded end of the main valve housing 136*a* of device 400 is screwed into the upwardly facing threaded opening of lug 402 as at 404 or, alternatively, an adapter (not shown) may be used for this connection. Lug 402 is attached as by a weld 406 to the exterior of a section 410 of the well tubing T.

In use, when the main valve opens, lift gas in the casing (not shown) enters the inlet 154*a* of gas lift valve 400, flows therethrough, and depresses the check valve 172*a*, compressing its spring 174*a*, and then flows through the flow port 410 into the tubing T. A drain passage may be provided as at 412 for draining the bore 414 in which the check valve slides and which contains the lower portion of its spring.

It may be desirable to install an adapter (not shown) onto the lower end of main valve housing 136*a* for containing the check valve and spring and then screwing the adapter into a conventional external lug provided on a gas lift mandrel available for use with such externally mounted gas lift valves.

Thus, it has been shown that a novel pilot operated gas lift valve has been provided which fulfills all of the objects set forth early in this application. It should be understood, however, that while the gas lift valve has been illustrated and described with respect to installations wherein lift gas is injected down the casing and is transferred through the gas lift valve into the tubing to aid in lifting production fluids to the surface, the subject gas lift valve can, as well be used in installations which are the reverse of that just mentioned where production is had through the casing and lift gas is injected down the tubing.

The foregoing description and drawing are explanatory and illustrative only and various changes in sizes, shapes, materials, and arrangements of parts, as well as certain details of construction, may be made within the scope of the appended claims without departing from the true spirit of the invention.

I claim:

1. A gas lift valve for use in a gas lift well having a well tubing, comprising:

(a) body means having a flow passage therethrough having inlet means at one end thereof and outlet means at the other end thereof, said inlet means including first and second spaced apart inlet openings;

(b) means on said body for attachment to means for securing the same in said well tubing such that said outlet means is in fluid communication with the interior of said well tubing and said inlet means is in fluid communication with the exterior of said well tubing;

(c) main valve seat means in said body means located between said first and second inlet openings;

(d) main valve means including an annular main valve member in said body means having a bore therethrough and a seat surface thereon and being movable between a first closed position of engagement of its seat surface with said main valve seat means for preventing fluid flow through its bore and a second open position wherein said main valve member is spaced from said main valve seat for permitting fluid flow therethrough;

(e) means biasing said annular main valve member toward said first closed position; and (f) pilot valve means for moving said annular main valve toward said second open position, said pilot valve means comprising:

(i) pilot seat means above said main valve seat communicating with said second inlet opening, (ii) pilot valve member means including a pilot valve member having a stem with a seating surface thereon and movable between a first closed position of engagement with said pilot seat means to close the same, and a second open position, said pilot valve stem being formed with an external annular recess, (iii) piston/cylinder means including a cylinder between said pilot seat and said main valve seat, and a piston slidable in said cylinder between an extended position in which it holds said main valve open and a retracted position in which it permits said main valve to return to said closed position, and (iv) diaphragm means sealingly engaged both with said stem and said body means, said diaphragm means having its lower side exposed to pressure admitted thereto through said second inlet and its upper side exposed to atmospheric pressure, (v) means biasing said pilot valve toward said closed position, (vi) whereby, when fluid pressure admitted through said second inlet and acting upon the lower side of said diaphragm reaches a predetermined value the pilot valve means will be lifted off its seat to admit fluid pressure into said cylinder to move said piston down to move said main valve from its closed to its open position, and whereby when the pressure admitted through said second inlet falls below said predetermined pressure, said biasing means will return said pilot valve member to its closed position and permit said main valve to return to its closed position;

(g) said body means being formed with an internal annular recess having its upper wall substantially aligned with the upper wall of said stem recess, said diaphragm having its outer edge portion sealingly disposed in said internal annular recess of said body while its inner edge portion extends inwardly into said external recess of said stem and sealingly engages the upper wall thereof; and (h) biasing means in said external annular recess of said pilot valve stem for forcing said inner edge of said diaphragm upwardly into firm sealing contact with said pilot valve stem, and check valve means is disposed in said flow passage of said body between said inlet and said outlet means for preventing backflow therethrough.

2. The device of claim 1, wherein said means for biasing said pilot valve is a coil spring surrounding said body and having its lower end resting upon a slidable ring which carries a cross pin extending through opposed openings in the body, the cross pin engaging the upper end of said pilot valve stem to thus transfer the force of the pilot valve spring thereto.

3. The device of claim 2, wherein a washer rests upon the upper end of said pilot valve spring and a bolt is threaded into the upper end of said body and has its head shouldered against the upper side of said washer to provide adjustment of the load of such spring which is applied to said pilot valve stem through said cross pin and ring.

4. The device of claim 3, wherein said cylinder is formed with the main valve seat at its lower end and with the pilot valve seat at its upper end, and said check valve means includes a check valve and a spring for biasing the same toward closed position.

5. The device of claim 4, wherein said piston is formed with at least one finger extending therefrom for engaging and moving said main valve downward, and said piston is provided with an external annular recess near its upper end, and said external annular recess carries one or more rings for reducing the clearance between said piston and said cylinder while permitting limited leakage therepast.

6. The device of claim 5, wherein said body means includes a spring housing threadedly attached to the upper pilot housing for covering the pilot valve spring, the threaded connection being sealable to maintain atmospheric pressure therein for acting upon the upper side of said diaphragm.

7. The device of claim 6, wherein said body carries an internal seal below said lower inlet which at all times sealingly engages the exterior of said main valve member, and the area sealed by this internal seal is a lesser area than that area of the main valve member sealed by contact with said main valve seat.

8. The device of claim 7, wherein said pilot valve stem and said body means are each provided with shoulder means coengageable to limit upward movement of said stem relative to said body.

9. The device of claim 8, wherein said piston is formed with a central bore therethrough and said pilot stem is provided with a probe extending downwardly from said seat surface thereon and extending through said piston bore with a close but free sliding fit, the lower end of said probe being exposed at all times to tubing pressure.

10. The device of claim 9, wherein said diaphragm is formed of a polymeric material and is formed with a first flat washer-like disk having a small opening at its center, a second such washer-like disk having a larger opening at its center, and means at the outer edges thereof connecting said first and second disks together in spaced-apart relationship, and a spacer ring surrounds said diaphragm in said internal annular recess of said body to limit the longitudinal dimension of said recess.

11. The device of claim 9, wherein said diaphragm is a disk of polymeric material with a central hole for receiving the reduced diameter portion of the upper pilot stem.

12. The device of claim 2, 3, 4, 5, 6, 7, 8, 9, 10, or 11, wherein said means on said body for attachment to means for securing said device in a well tubing is a thread for attaching a locking device for removably landing and locking the device in the well tubing, and wherein said locking device is included in combination.

13. The device of claim 2, 3, 4, 5, 6, 7, 8, 9, 10, or 11, wherein said means on said body for attachment to means for securing said device to the well tubing is adapting means for attaching the device to the exterior of the well tubing.

14. The device of claim 11, wherein said upper pilot housing is formed with an external chamfer at its lower end, and said diaphragm is formed with a ridge on the upper side thereof and at its outer edge, and said ridge is engaged by the lower chamfered end of said upper pilot housing to capture the outer edge of said diaphragm and improve the seal between said diaphragm and said body means.

15. The device of claim 11, wherein said intermediate pilot housing is formed with an upwardly opening recess therein, and a resilient seal ring carried in said recess sealingly engages the lower side of said diaphragm.

16. The device of claim 14 or 15, wherein said diaphragm is formed of polymeric material.

17. The device of claim 14 or 15, wherein said diaphragm is formed of elastomeric material.

* * * * *